US009078517B2

(12) United States Patent
Rehage

(10) Patent No.: US 9,078,517 B2
(45) Date of Patent: Jul. 14, 2015

(54) QUICK FASTENING DEVICE

(75) Inventor: Daniel Rehage, Bielefeld (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 140 days.

(21) Appl. No.: 13/254,475

(22) PCT Filed: Mar. 3, 2010

(86) PCT No.: PCT/EP2010/052707

§ 371 (c)(1),
(2), (4) Date: Nov. 15, 2011

(87) PCT Pub. No.: WO2010/100198

PCT Pub. Date: Sep. 10, 2010

(65) Prior Publication Data

US 2012/0061534 A1 Mar. 15, 2012

(30) Foreign Application Priority Data

Mar. 6, 2009 (DE) ..... 20 2009 003 045 U

(51) Int. Cl.
*A47B 88/04* (2006.01)
*F24C 15/16* (2006.01)

(52) U.S. Cl.
CPC ..... *A47B 88/044* (2013.01); *F24C 15/168* (2013.01); *A47B 88/0418* (2013.01)

(58) Field of Classification Search
USPC ..... 248/228.7, 230.7, 231.81; 403/397, 403/399, 385; 211/126.15, 90.01, 90.02, 211/151, 26; 312/410, 330.1, 334.6, 334.5, 312/350; 24/457
See application file for complete search history.

(56) References Cited

U.S. PATENT DOCUMENTS

| | | | | | |
|---|---|---|---|---|---|
| 656,274 | A * | 8/1900 | Streeter | 403/387 |
| 673,144 | A * | 4/1901 | Streeter | 403/387 |
| 1,418,699 | A * | 6/1922 | Collins | 403/385 |
| 4,900,184 | A * | 2/1990 | Cleveland | 403/397 |
| 5,407,084 | A | 4/1995 | Remmers | |
| 5,497,728 | A * | 3/1996 | Watanabe | 119/452 |
| 5,697,591 | A * | 12/1997 | Cooper | 248/229.16 |
| 5,715,956 | A * | 2/1998 | Yoshida | 211/182 |
| 6,453,523 | B1 * | 9/2002 | Teidemann | 24/546 |
| 6,606,964 | B2 * | 8/2003 | Marchioro | 119/452 |
| 6,669,036 | B1 * | 12/2003 | Yang et al. | 211/181.1 |
| 7,316,203 | B2 * | 1/2008 | Marchioro | 119/474 |
| 7,469,515 | B2 * | 12/2008 | Minor | 52/719 |
| 7,640,701 | B2 * | 1/2010 | Rutherford | 52/243 |
| 8,366,059 | B2 * | 2/2013 | Fannon et al. | 248/74.3 |
| 8,573,720 | B2 * | 11/2013 | Wittgrebe | 312/410 |
| 2004/0144327 | A1 * | 7/2004 | Marchioro | 119/452 |
| 2006/0049732 | A1 * | 3/2006 | Prentner et al. | 312/334.1 |
| 2006/0186291 | A1 * | 8/2006 | Conway | 248/231.81 |

FOREIGN PATENT DOCUMENTS

| | | |
|---|---|---|
| EP | 1 840 473 | 10/2007 |
| WO | 2007/074114 | 7/2007 |
| WO | 2007/090738 | 8/2007 |

* cited by examiner

*Primary Examiner* — Alfred J Wujciak
(74) *Attorney, Agent, or Firm* — Barnes & Thornburg LLP

(57) ABSTRACT

A quick fastening device for fastening a guide rail to a horizontally extending rod having a bent end section on each end of the rod. The bent end sections each are fixed to a post of a grid. Each bent end section is encompassed by a clamp connected to the guide rail. The quick fastening device includes a stop abutting against the post on a side facing the guide rail. The stop is formed on the clamp.

13 Claims, 16 Drawing Sheets

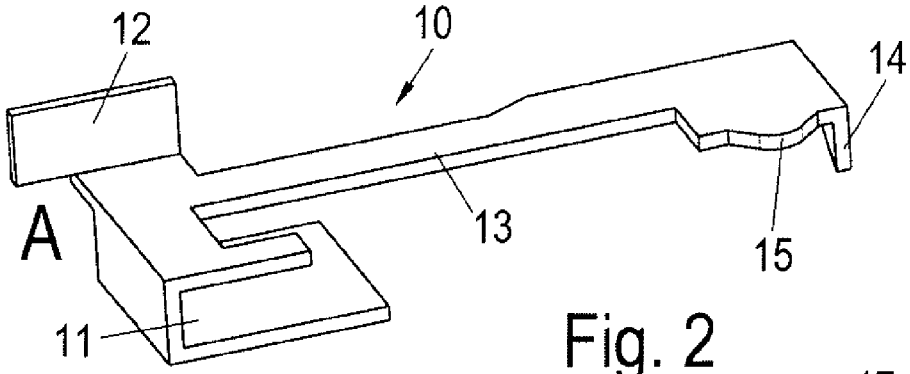
Fig. 2
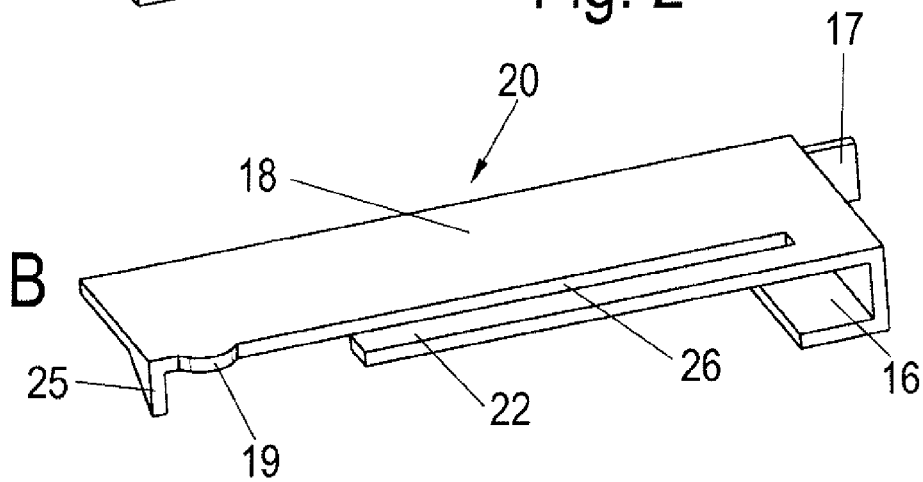
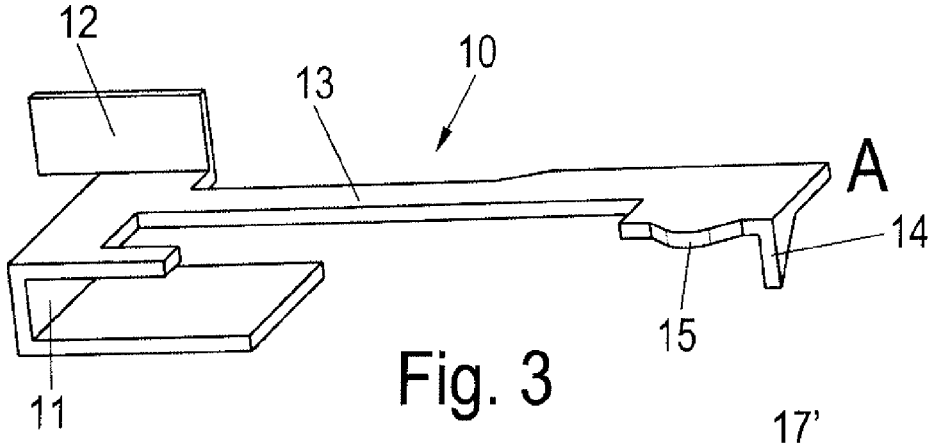
Fig. 3
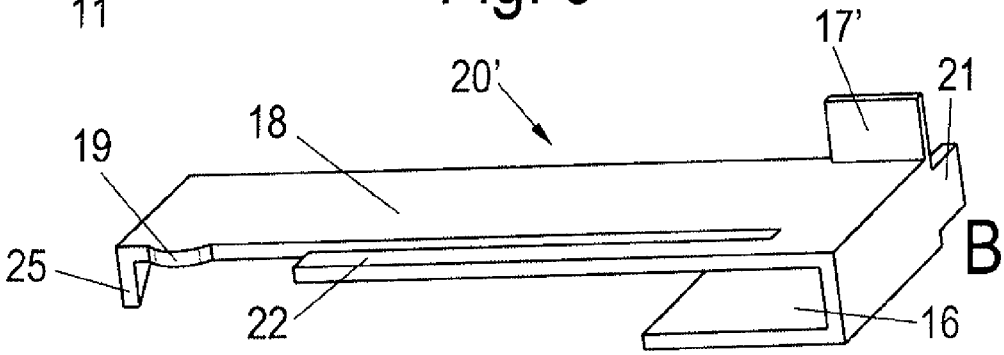

QUICK FASTENING DEVICE

CROSS-REFERENCE TO RELATED APPLICATION

This application is a national stage of International Application PCT/EP2010/052707, filed Mar. 3, 2010, and claims benefit of and priority to German Patent Application No. 20 2009 003 045.8, filed Mar. 6, 2009, the content of which Applications are incorporated by reference herein.

BACKGROUND AND SUMMARY

The present disclosure relates to a quick fastening device for fastening a guide rail to a horizontally extending rod which includes one bent section at each opposite side. The bent end sections are fixed to posts of a grid-like side part. The at least one bent end section is encompassed by a clamp connected to the guide rail.

WO 2007/074114 discloses a quick fastening device for fastening a guide rail of a pull-out guide to a grid-like side part. For this purpose, the horizontal rod is encompassed in a bent end region by a clip-type retaining section so that the two retaining sections can be slid in one direction parallel to the bent end sections. This enables easy assembly but the guide rails of the pull-out guide usually protrude into the interior of a household appliance adjacent to the horizontal rod.

WO 2007/090738 discloses a quick fastening for a guide rail, in which two clip-like retaining elements are provided, which can be slid onto the bent end sections in one direction parallel to the longitudinal direction of the rod. As a result, assembly can be accomplished in a simple manner on a front side. Here also the clip-type retaining sections do not only encompass the bent end section but also the region of a rod running in the longitudinal direction so that the structure is relatively large towards the inside.

It is, therefore, an object of the present disclosure to provide a quick fastening device for fastening a guide rail to a horizontally extending rod and/or to a vertically extending post. Such a device has a compact structure and enables a simple fastening of the guide rail. The quick fastening device is for fastening a guide rail to a horizontally extending rod having a bent end section on each end of the rod. The bent end sections each are fixed to a post of a grid. Each bent end section is encompassed by a clamp connected to the guide rail. The quick fastening device includes a stop abutting against the post on a side facing the guide rail. The stop is formed on the clamp.

According to the present disclosure, a stop lying against a post on the side facing the guide rail is formed on at least one of the clamps so that the stop forms a securing means against displacement of the quick fastening device in the direction of the post. It is thereby achieved that the fastening points on the region of the longitudinal extension of the rod can be omitted and the fastening is disposed closer to the post. That is, on an outer wall of an inner compartment, since the side grid with the rods is usually fixed on a side wall of an inner compartment, for example, in a baking oven. The usable interior space is thereby enlarged and the guide rail of the pull-out guide can be positioned further outwards.

In an embodiment according to the present disclosure, a stop for abutting against a post on the side facing the guide rail is formed on both clamps, so that under loading of the guide rail towards the post a supporting is accomplished at both clamps and a pivoting movement of the quick fastening device is prevented. The stop can, within the scope of the present disclosure, be configured to be plate-shaped and form a plane stop surface on a U-shaped holder. The U-shaped holder has an advantage such that not only forces can be transmitted in the direction of the post but tensile forces of the guide rail can also be absorbed by the post through the U-shaped holder. This requires that the U-shaped holder can be inserted with one leg between the post and the side wall, for example, of a baking oven.

For a stable fastening of the quick fastening means or device, a clamp is fixed on the bent end section of a rod by latching means. The latching means can, for example, be formed by bendable webs on a clamp so that easy assembly is ensured.

For a fixing of the quick fastening device, at least one clamp includes two U-shaped receptacles disposed at an angle to one another. As a result, these clamps can be mounted by inserting a bent end section or the post into a first receptacle and then pivoting in such a manner that the second U-shaped receptacle engages with a bent end section or the post. The clamp has a minimal material requirement since the clamps can be configured in a particularly compact and material-saving manner by forming two U-shaped receptacles.

For easy assembly of both clamps on the guide rail, both clamps can, in accordance with the present disclosure, be fixed on a strip which is connected to the guide rail. As a result, both clamps can be pre-assembled on the strip so that only one fastening step is required, for example, fixing the strip on the guide rail. It is within the scope of the present disclosure to form the clamps integrally with the guide rail so that an additional strip can be dispensed with. It is within the scope of the present disclosure to include the direct fixing of the clamps on the guide rail. This can be accomplished, for example, by a positive or firmly bonded connection.

For a compact arrangement of the guide rail on the side grid, the guide rail is disposed at least partially above the rod so that, by the quick fastening device, the guide rail is not positioned next to a horizontal rod but above so that the usable interior space of a baking oven or other household appliance is enlarged. The same food racks can be used which could be inserted into the side grid before mounting the pull-out guide on the side grid. Consequently, in the fastening arrangement according to the present disclosure, pull-out guides can easily be retrofitted for increasing the comfort. The user can reuse the same food racks.

The latching means may, for example, encompass the rod or the post over more than half the diameter so that a secure hold is ensured. The rod or the post may be configured to be circular in cross-section so that the latching means project by half or more to the rod or the post and ensure a secure fixing.

Other aspects of the present disclosure will become apparent from the following descriptions when considered in conjunction with the accompanying drawings.

BRIEF DESCRIPTION OF THE DRAWINGS

FIGS. 2A and 2B show two views of the clamps of the quick fastening device of FIG. 1.

FIGS. 3A and 3B show two views of another embodiment of clamps of a quick fastening device, in accordance with the present disclosure.

DETAILED DESCRIPTION

Figure 1A:
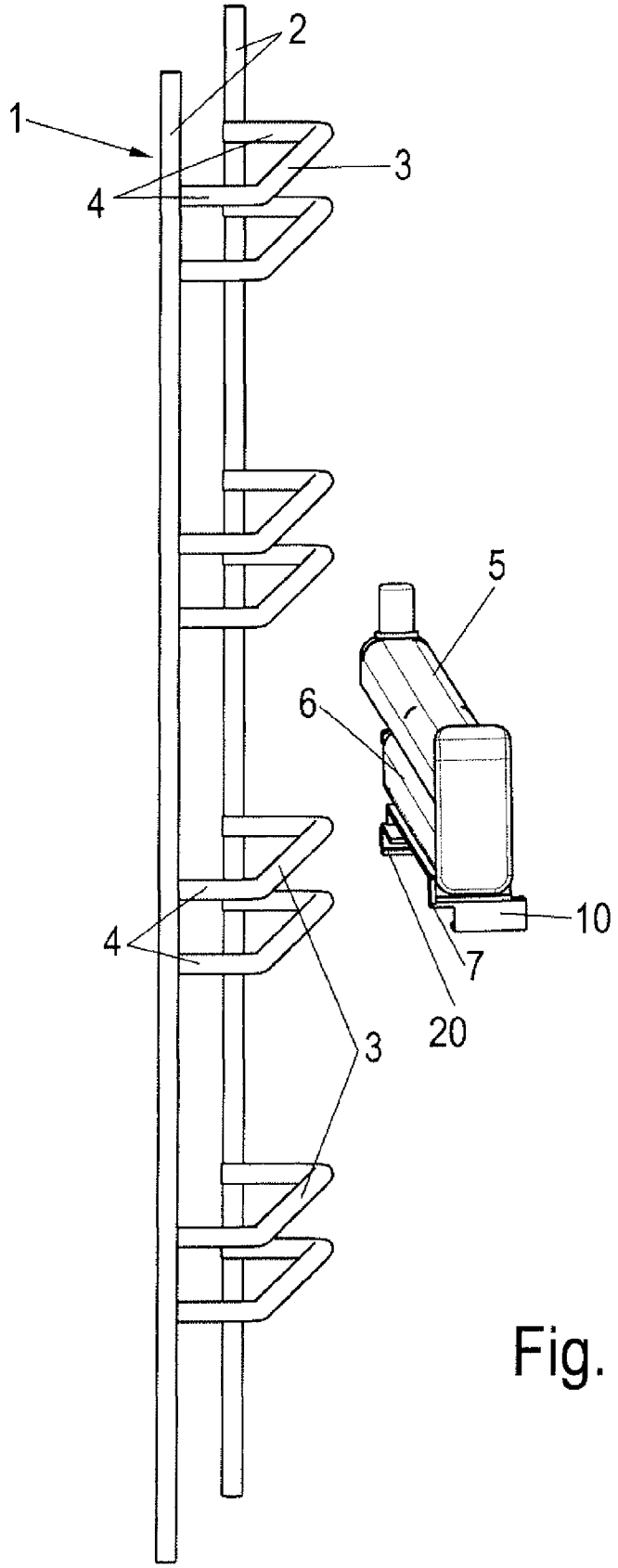
FIGS. 1A to 1C show several views of a quick fastening device according to a first embodiment during assembly, in accordance with the present disclosure.
Figure 1B:
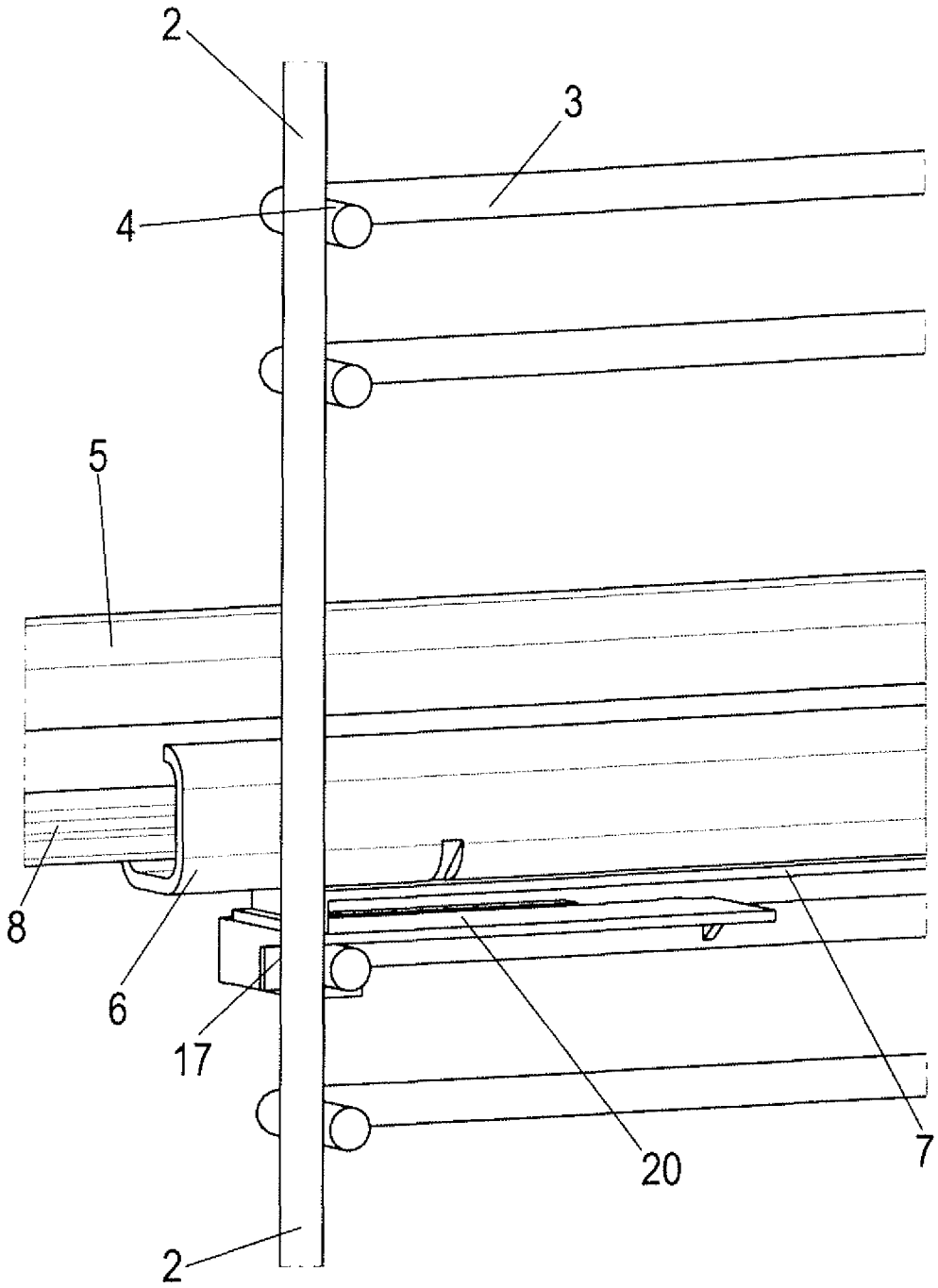
Figure 1C:
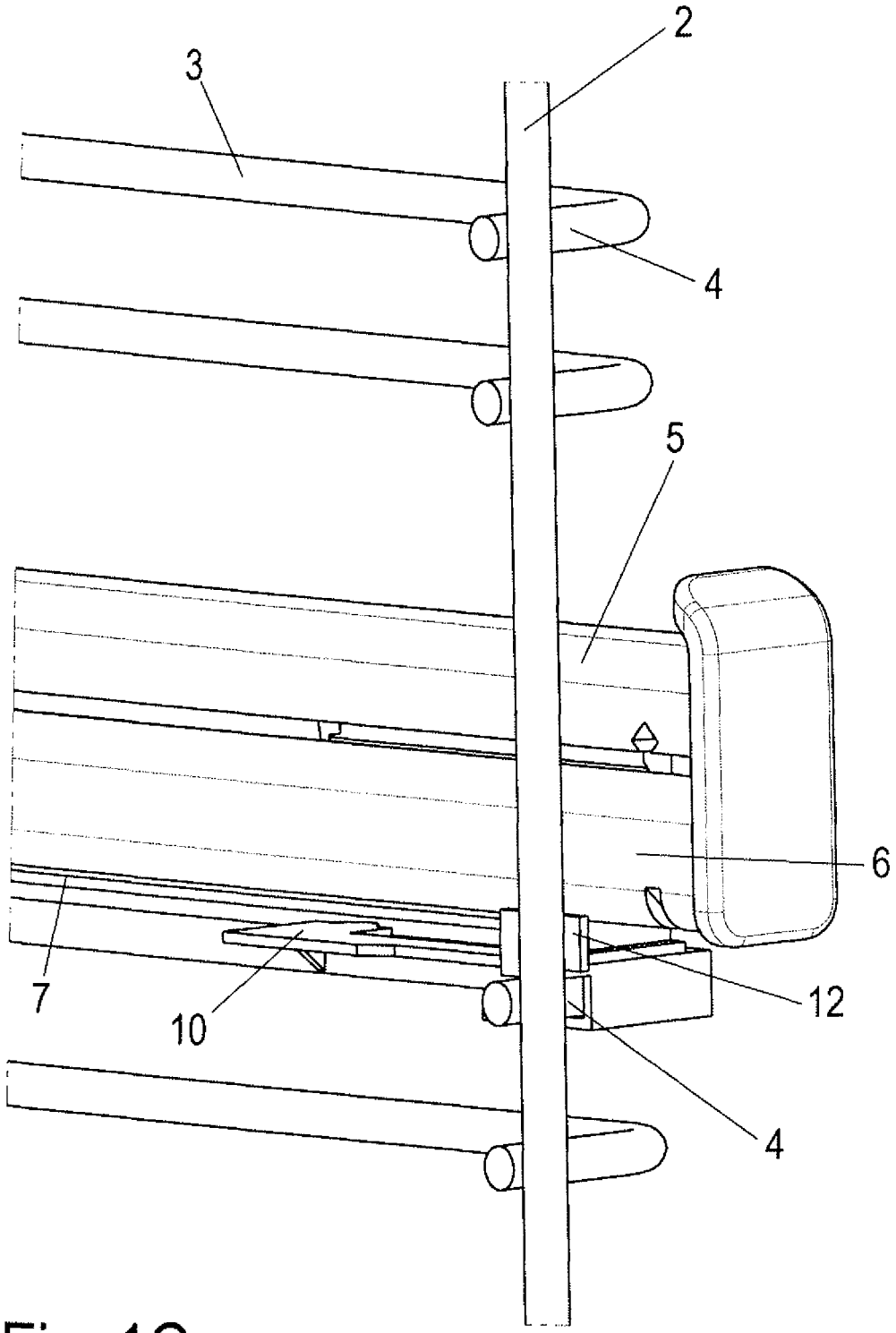

A quick fastening device for fixing a pull-out guide on a side grid 1 is used, for example, for baking ovens but can also be used for other household appliances or in the furniture area.

The side grid 1 includes two vertical posts 2 on which a plurality of horizontal rods 3 are fixed. The rods 3 are each arranged in pairs but other forms of a side grid 1 are within the scope of the present disclosure. Each horizontal rod 3 includes a middle section which extends in the longitudinal direction of the rod 3 and bent end sections 4 are provided on opposite sides, which run substantially at right angles to the longitudinal direction. The bent end sections 4 are fixed on the posts 2 at the ends, for example, by weld spots.

Two clamps 10 and 20, which are fixed on a strip 7, are provided for assembling the pull-out guide. The strip 7 is fixed on a guide rail 6 of the pull-out guide on which one or more running rails 5 are movably mounted by, for example, rolling bodies. In addition, a pull-out lengthening middle rail 8 is located between the guide rail 6 and the running rail 5 which is also mounted by rolling bodies. In this case, a first clamp 10 encompasses bent end section 4 on a front side of the side grid 1 and the second clamp 20 encompasses a rear bent end section 4 on a rear-side area of the side grid 1.

The rear clamp 20 includes a U-shaped receptacle 16 on which a plate-shaped stop 17 is formed. The bent end section 4 is inserted in the U-shaped receptacle 16 while the plate-shaped stop 17 abuts against the vertical post 2.

The front clamp 10 includes a U-shaped receptacle 11 for insertion of the bent section 4, where a plate-shaped stop 12 rests adjacently on the front post 2.

The quick fastening device with the clamps 10 and 20 is assembled by sliding the clamps 10 and 20 in the horizontal direction onto a rod 3 until the clamps 10 and 20 engage by gripping behind the projections 14 or 25 behind the rod 3 at the side grid 1.

As shown in FIGS. 2A and 2B, the front clamp 10 comprises a U-shaped receptacle 11 for the bent end section 4 and a plate-shaped stop 12 for abutting against a post 2. Furthermore, a bendable web 13 is provided on which a bent projection 14 is disposed at the end. The projection 14 grips behind the rod 3 in a longitudinal region while a support 15 formed on the web 13 abuts against the upper side of the rod 13 in the area of the longitudinal extension. The clamps 10 thereby ensure a secure holding of the guide rail 6 by supporting in different directions.

The rear clamp 20 includes a U-shaped receptacle 16, on which a plate-shaped stop 17 is configured adjacently for abutment against a post 2. At the rear clamp 20, a web 22 is fixed on the strip 7 where an adjacent plate 18 is spaced apart by a slot 26 in the longitudinal direction of the rod 3 and is thereby bendable. On the side opposite the receptacle 16, the plate 18 comprises a downwardly directed projection 25 which grips behind a rod 3 and abuts against the rod 3. Furthermore, a support 19 is provided, which abuts against an upper region of the rod 3 so that the clamp 20 ensures a transfer of forces from the strip 7 to the side grid 1 and forces are transferred in different directions by corresponding stop faces.

FIGS. 3A and 3B show two clamps 10 and 20' which are used in a modified embodiment of a quick fastening device, in accordance with the present disclosure. The clamp 10 corresponds to the above embodiment while the clamp 20' has a difference adjacent to the U-shaped receptacle 16. Unlike in the preceding embodiment, the plate-shaped stop 17 of this embodiment is not formed as an extension of the plate 18 but projects vertically upwards as a plate-shaped stop 17'. In addition, another stop in the form of a plate 21 is formed on the side facing the post 2, which is disposed as an extension of the receptacle 16. As a result, the plate 21 can abut laterally against the post 2 so that a fastening is achieved by sliding the clamp 20' in the horizontal direction parallel to the bent end sections 4 although the receptacle 16 does not abut or must not abut against the bent end section 4 with its base in the pull-out direction.

Figure 4A:
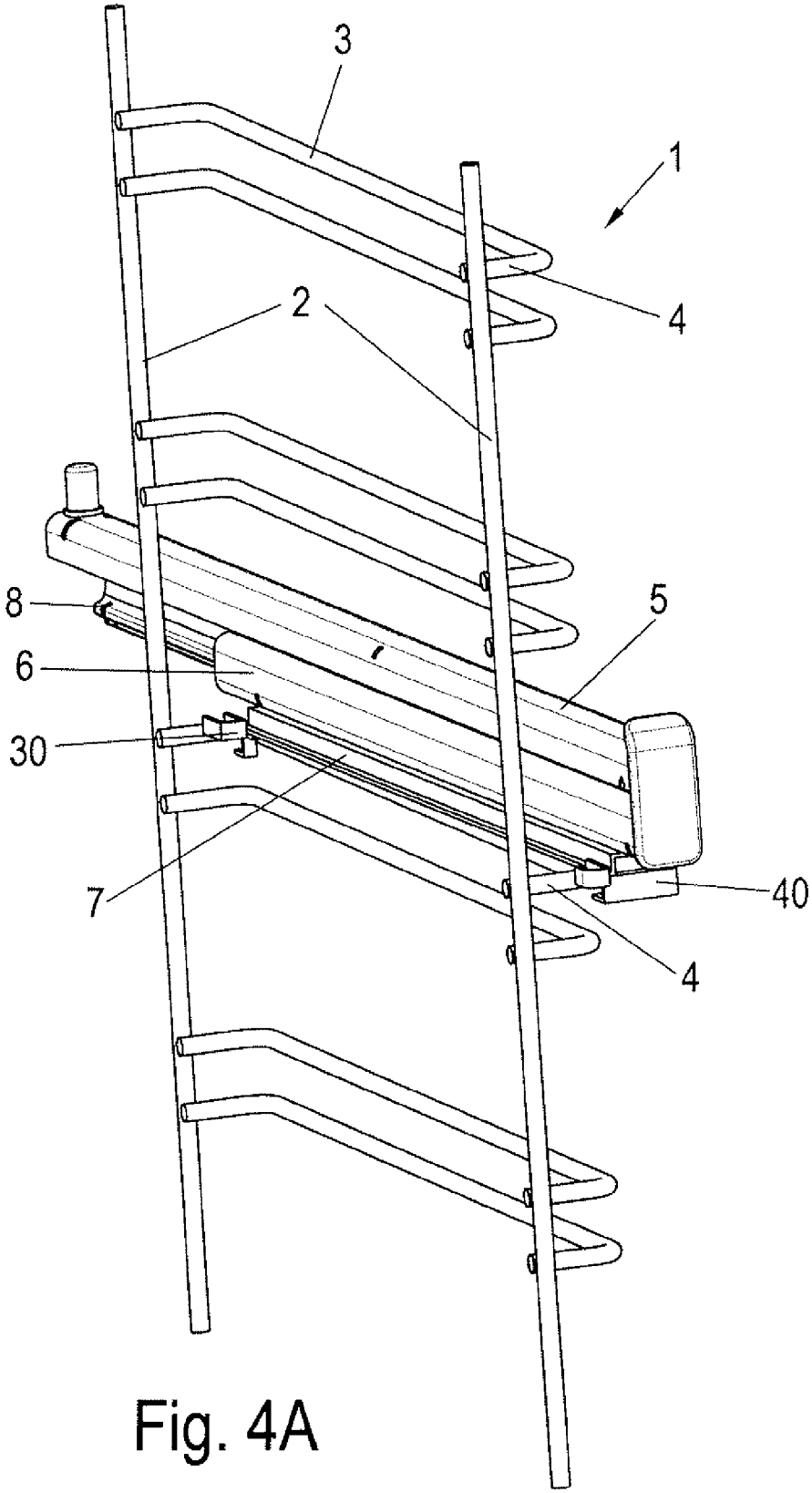
FIGS. 4A to 4C show several views of a second embodiment of a quick fastening device during assembly, in accordance with the present disclosure.
Figure 4B:
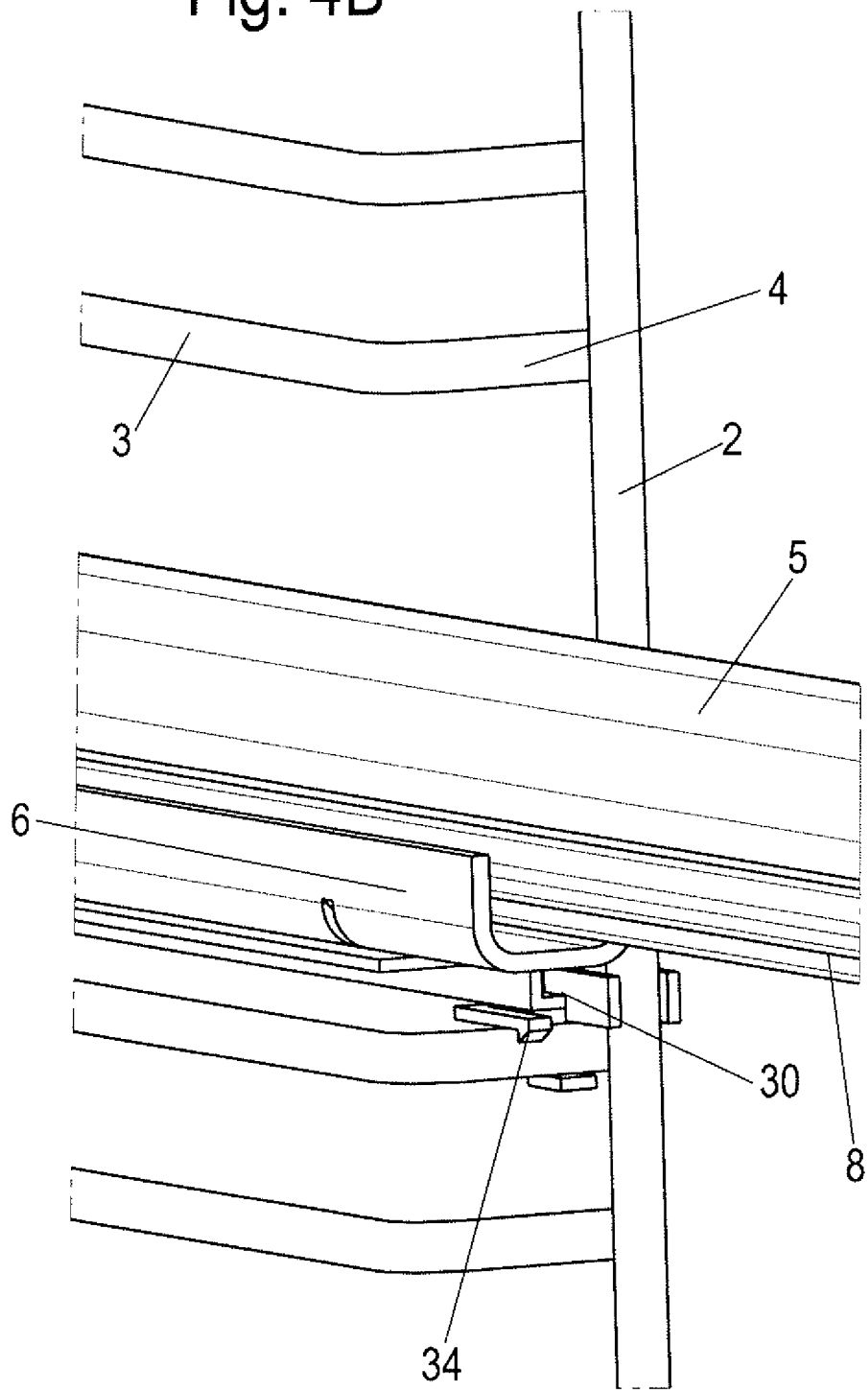
Figure 4C:
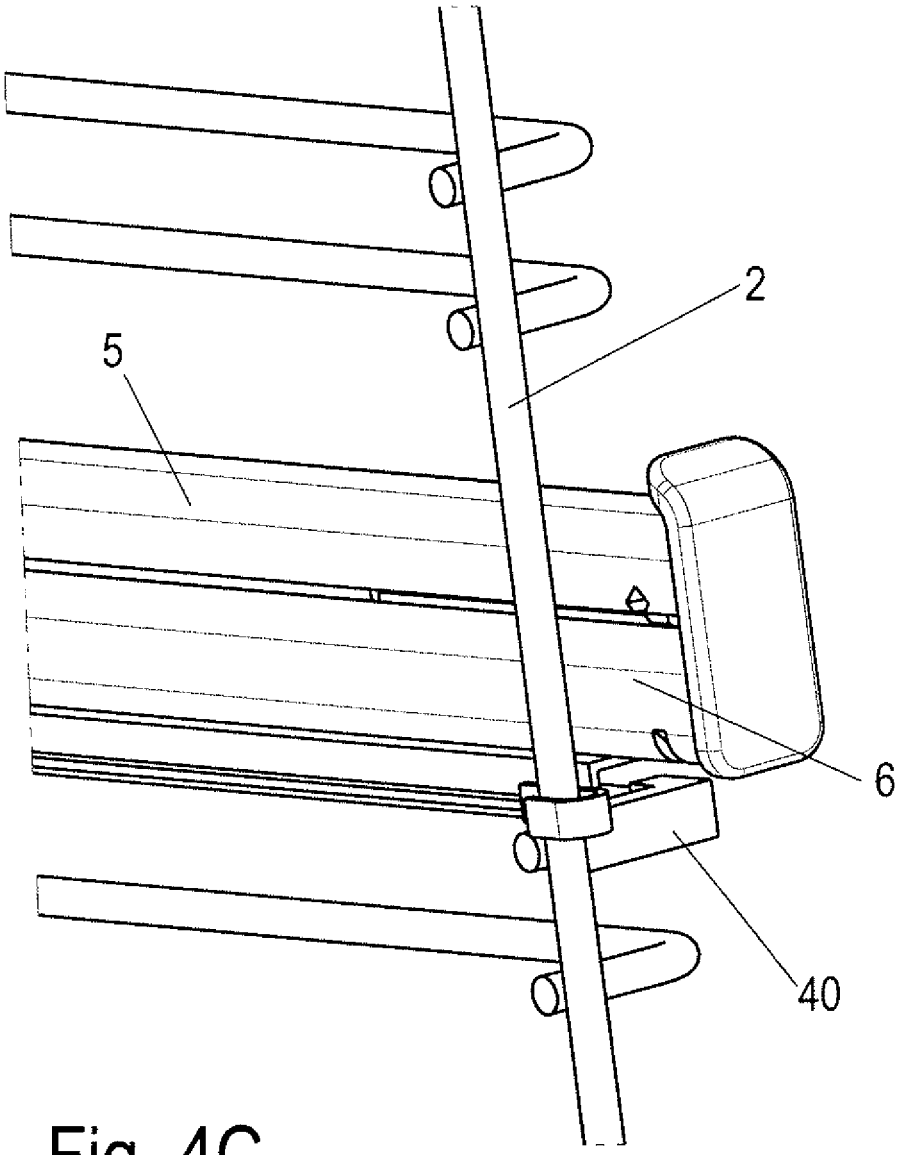

FIGS. 4A to 4C show another embodiment of a quick fastening device, in accordance with the present disclosure, which is mounted on a side grid 1. This quick fastening device includes a front clamp 40 and a rear clamp 30 which can be pushed onto a rod 3 from a front side. The appurtenant clamps 40 and 30 are shown in FIGS. 5A and 5B.

The front clamp 40 includes a U-shaped receptacle 41 which, for example, can be pushed around the bent end section 4 of the rod 3 located at the front. Another U-shaped receptacle 42 is further formed on the clamp 40, which is located at an angle to the receptacle 41 and serves to encompass the vertical post 2.

The rear clamp 30 includes a U-shaped receptacle 31 which, for example, can be pushed around the rear post 2. In order to secure the quick fastening device against lifting towards the front, a latching receptacle 32 is formed on the rear clamp 30, which includes a lower web 35 which grips under the bent end sections 4 of the rod 3. An upper web 33 is furthermore formed, on which a detent 34 is provided on the side facing the web 35. Upon pushing the clamps 30 onto the bent end section 4, the web 33 is bent upwards by the detent 34 until the detent 34 grips behind the bent end section 4 and thereby secures the quick fastening device against withdrawal. In order to reliably prevent withdrawal due to high pull-out forces, the detent 34 can, for example, be the same or greater than half the diameter of the rod 3 in its extension to the web 35.

Figure 5:
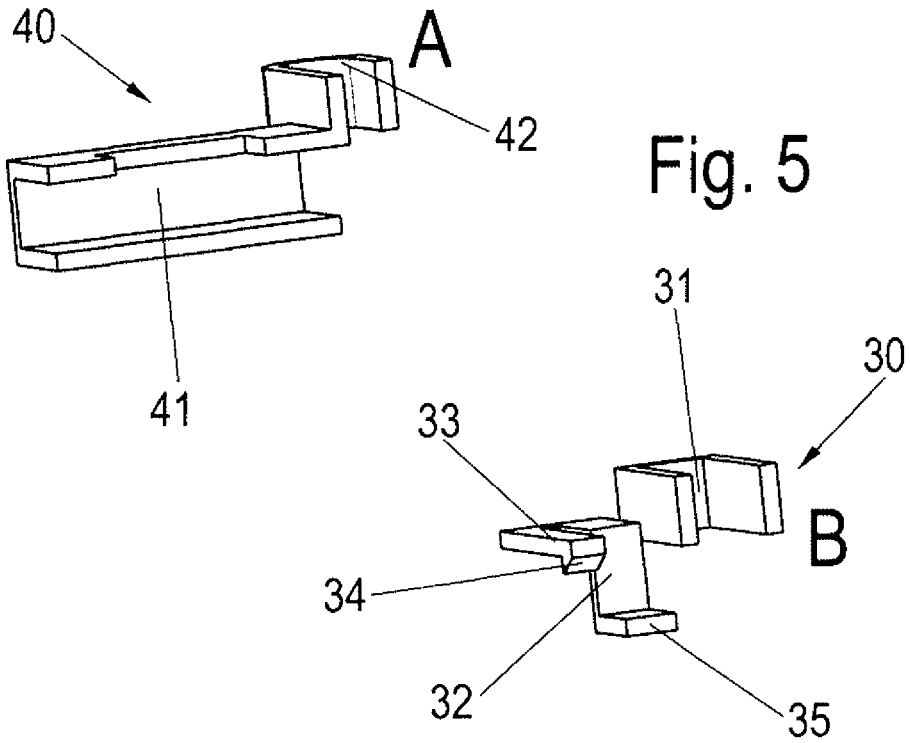
FIGS. 5A and 5B show two views of the clamps of the quick fastening device of FIGS. 4A to 4C.
Figure 6:
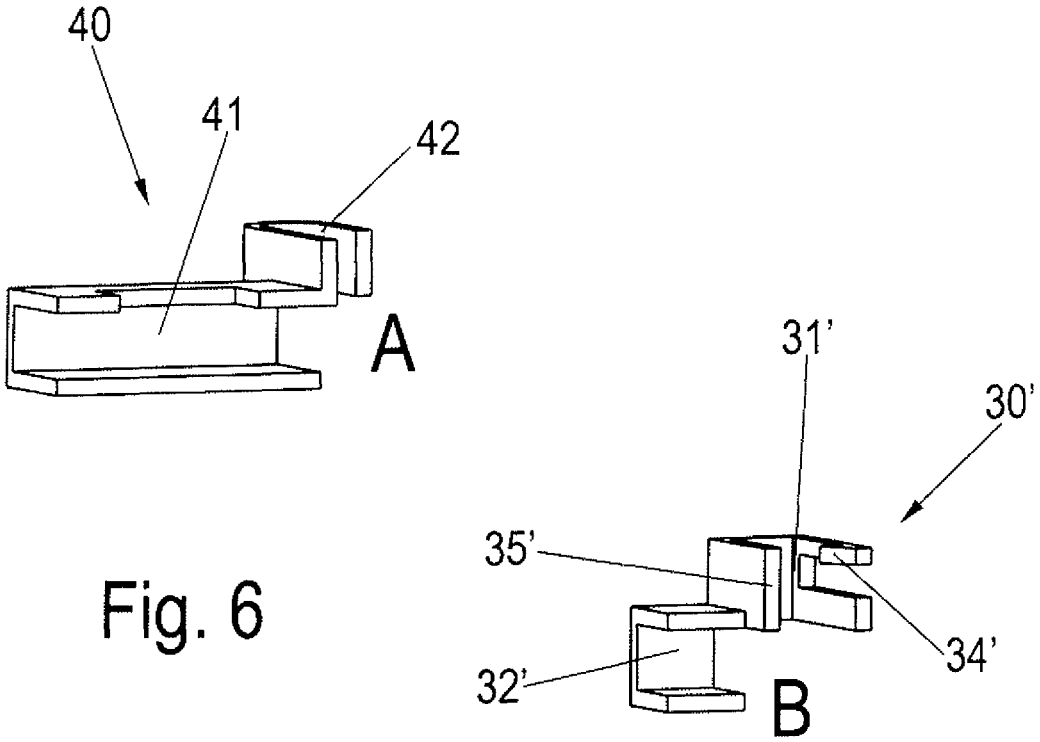
FIGS. 6A and 6B show two views of modified clamps of a quick fastening device, in accordance with the present disclosure.

FIGS. 6A and 6B show another embodiment of the clamps 40 and 30', according to the present disclosure, where the front clamp 40 corresponds to the embodiment of FIG. 5A. The rear clamp 30' is modified such that the latching means is not disposed on the receptacle for fixing of the bent end section 4 but on a U-shaped receptacle 31' for fixing the clamps 30' on the vertical post 2. For this purpose, a wall of the leg is divided on the U-shaped receptacle 31' and a detent 34' is formed on the inwardly directed side, which is disposed bendably on the receptacle 31' so that when inserting the post 2 into the receptacle 31', the detent 34' grips behind the post 2. An opposite leg 35' of the receptacle 31' serves as a counter bearing for the detent 34'. A second U-shaped receptacle 32' for the bent end section 4 of the rod 3 is formed perpendicular to the receptacle 31'.

Figure 7A:
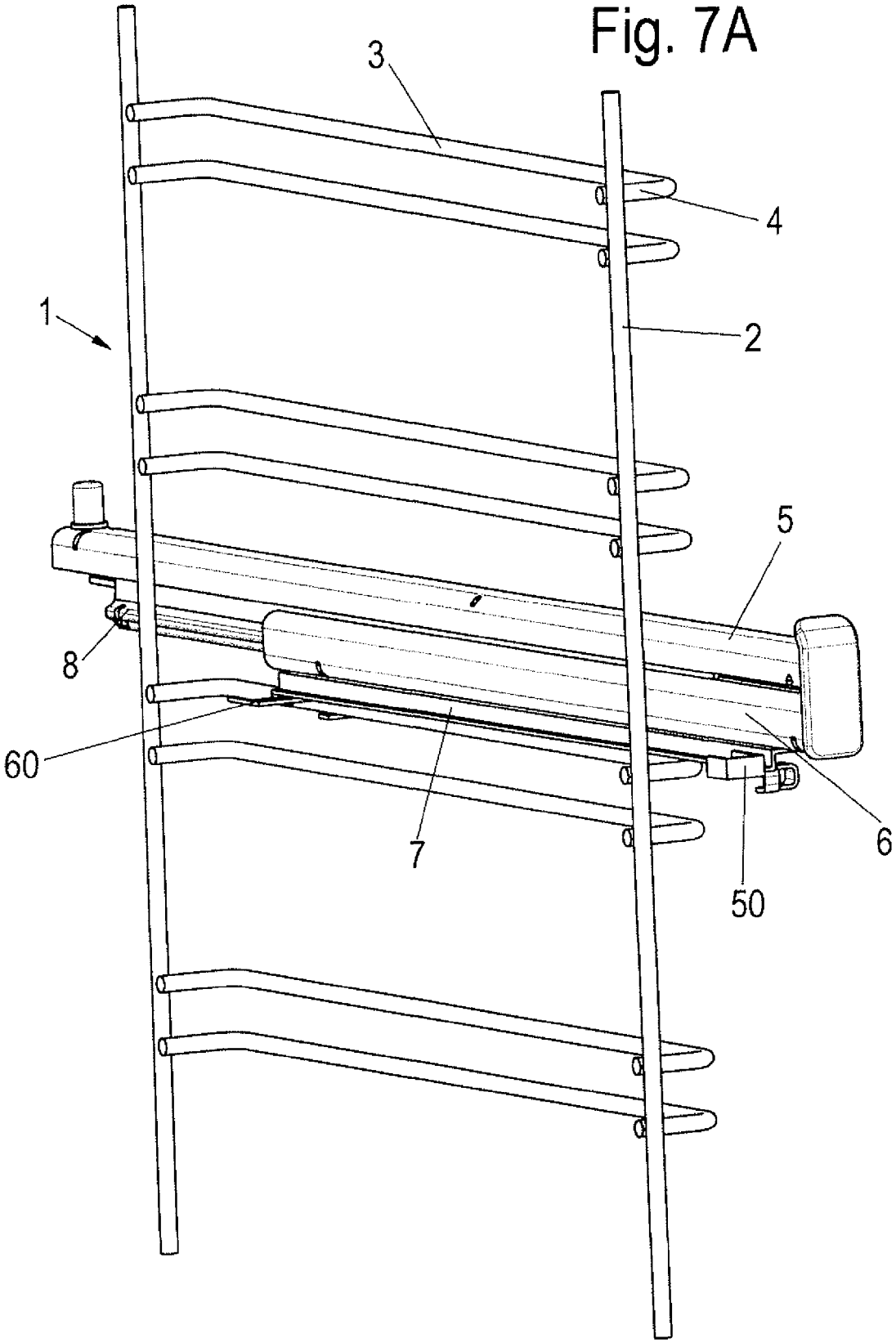
FIGS. 7A to 7C show several views of a third embodiment of a quick fastening device during assembly, in accordance with the present disclosure.
Figure 7B:
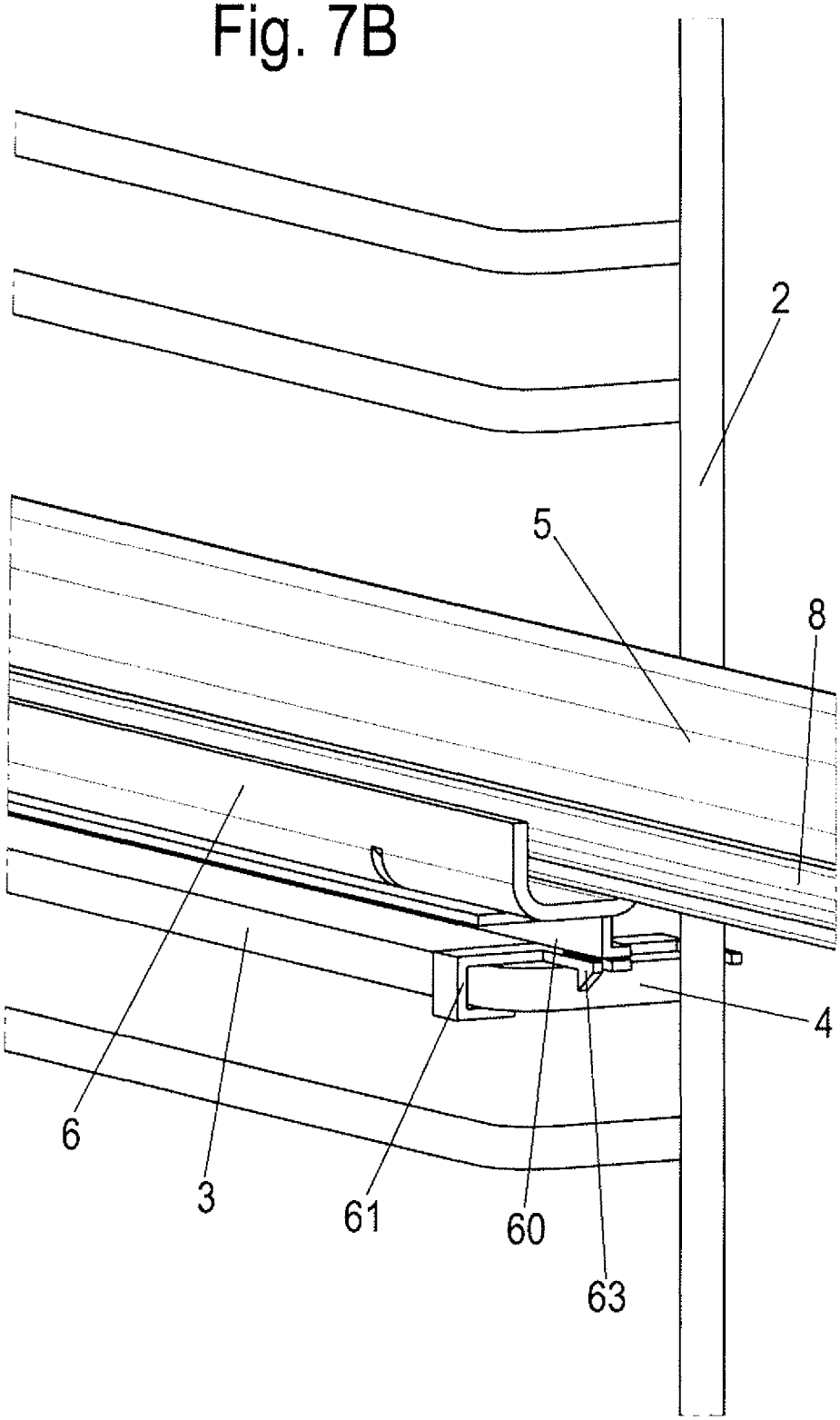
Figure 7C:
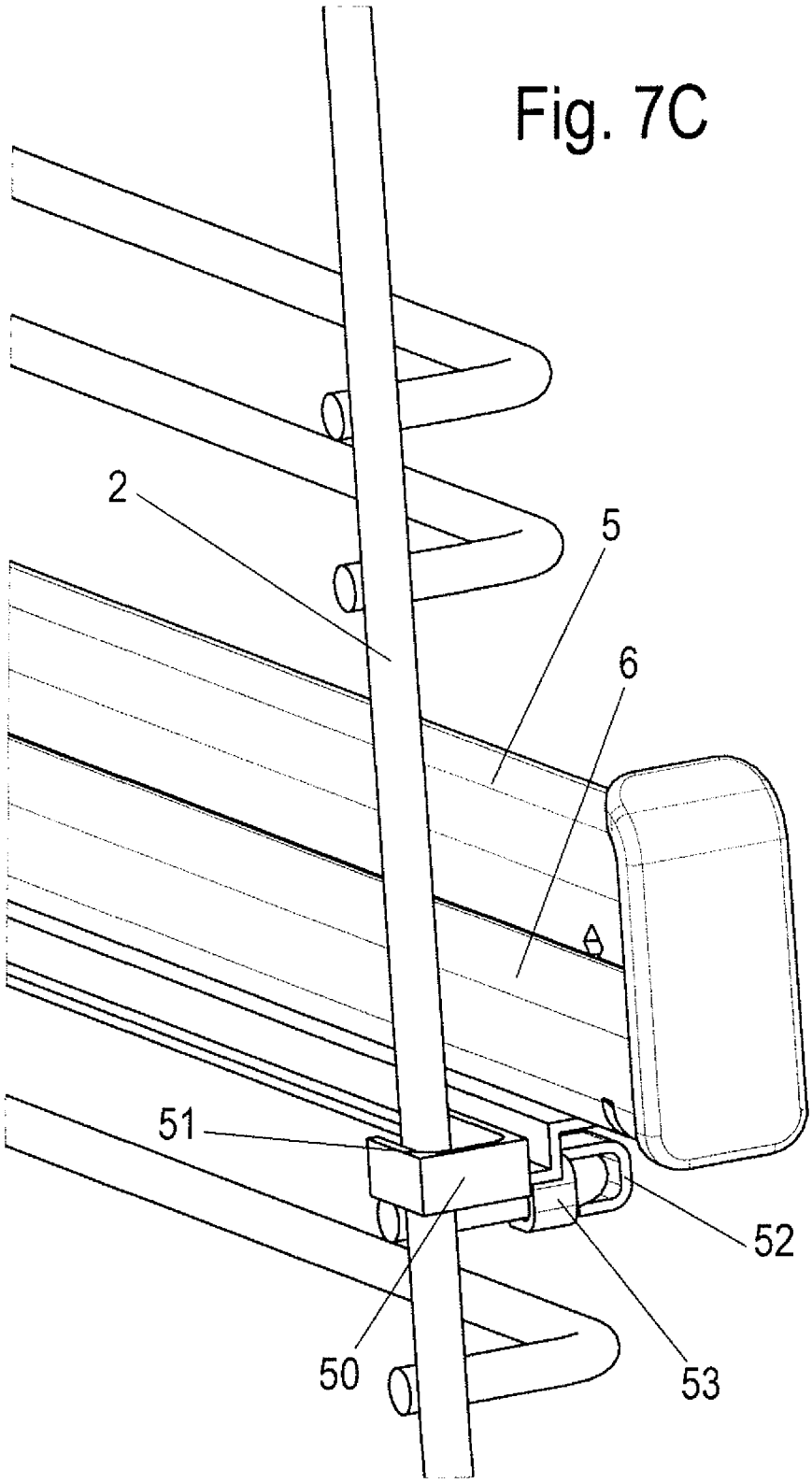

FIGS. 7A to 7C show another embodiment of a quick fastening device, according to the present disclosure, by which the one guide rail 6 of a pull-out guide is mounted on a side grid 1. The quick fastening device includes a front clamp 50 and a rear clamp 60 which are fixed on the guide rail 6 or a strip 7 connected to the guide rail 6.

Figure 8:
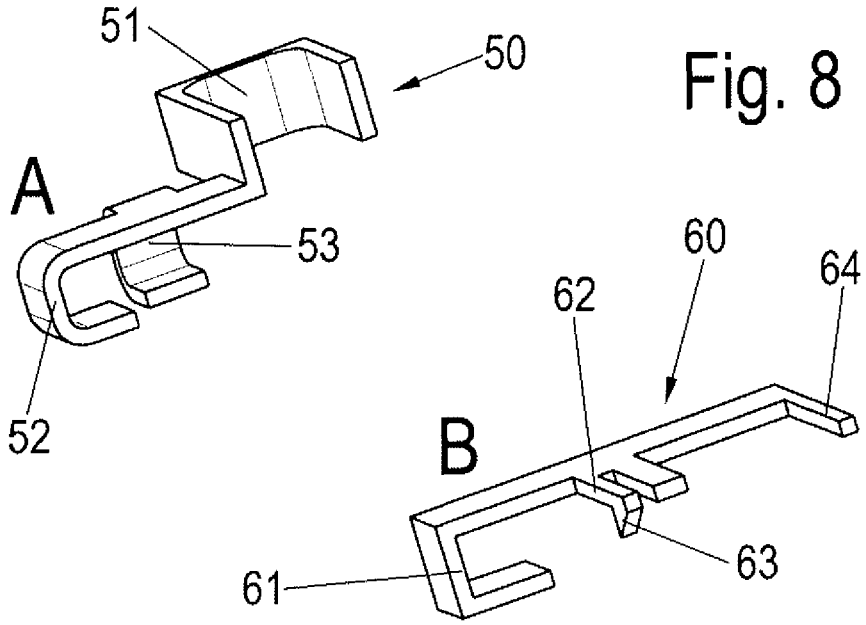
FIGS. 8A and 8B show two views of the clamps of the quick fastening device of FIGS. 7A to 7C.

As can be identified from FIGS. 8A and 8B, the front clamp 50 includes a U-shaped receptacle 51 for encompassing the vertical post 2 of the side grid 1. Another U-shaped receptacle 53 is formed at an angle to the receptacle 51, by which a bent end section 4 of the rod 3 is encompassed. Another U-shaped receptacle 52 is formed integrally with the U-shaped receptacle 53, which is configured to encompass a section of the rod 3 extending in the longitudinal direction. The U-shaped receptacles 51, 52 and 53 are each disposed at right angles to one another so that a transfer of forces is possible in five directions without pulling away the clamps 50 from the side grid 1.

The rear clamp 60 includes a U-shaped receptacle 61 which serves to encompass the rod 3 in the area of the longitudinal extension. A latching web 62 is formed adjacent to the U-shaped receptacle 61, which has a downward-pointing detent 63. When pushing on the clamps 50 and 60, the web 62 is bent upwards by a bent end section 4 of a rod 3 and the detent 63 engages behind the bent end section 4 so that the quick fastening device is secured against pulling away to the front. The clamp 60 includes a stop web 64 which grips behind the vertical post 2 in order to avoid pulling away towards the interior in the rear area.

Figure 9:
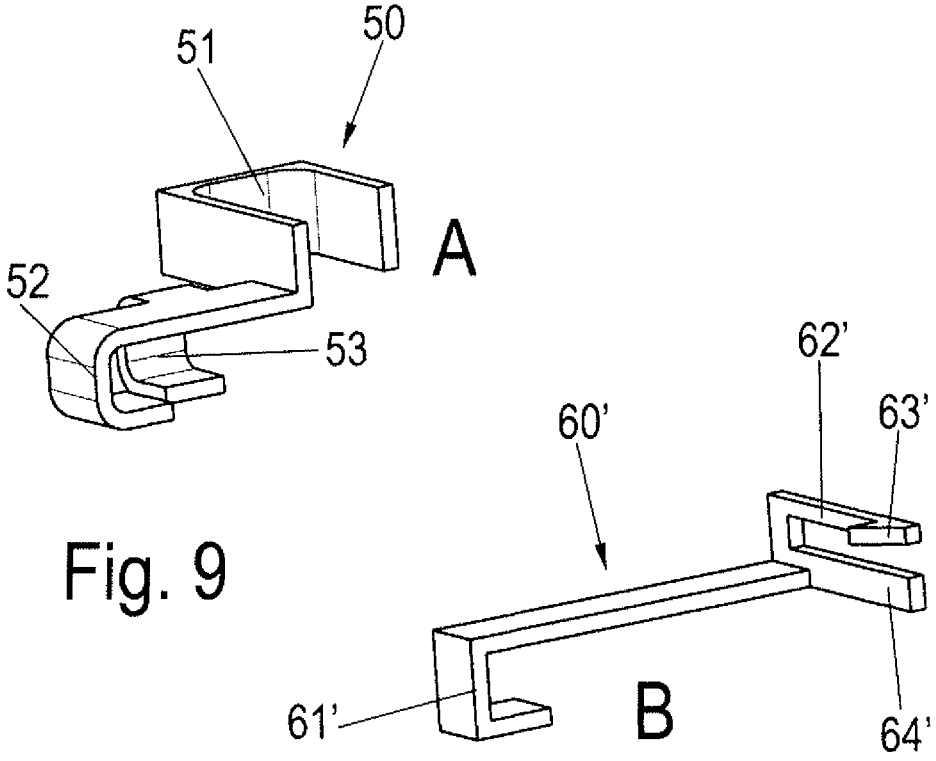
FIGS. 9A and 9B show two views of modified clamps of a quick fastening device, in accordance with the present disclosure.

FIGS. 9A and 9B show another embodiment of two clamps 50 and 60', in accordance with the present disclosure, with the clamp 50 corresponding to the preceding embodiment. A U-shaped receptacle 61' that encompasses the rod 3 is formed at the rear clamp 60'. Unlike in the preceding embodiment, the latching means do not act on the bent end section 4 but on the post 2. For this purpose, a stop web 64' is formed at the end on the clamp 60' which grips behind the post 2 on the side facing away from the interior. A web 62' is formed adjacently parallel to the stop web 64', on which a latching projection 63' is formed which grips behind the post 2 when pushing on the clamp 60'.

Figure 10A:
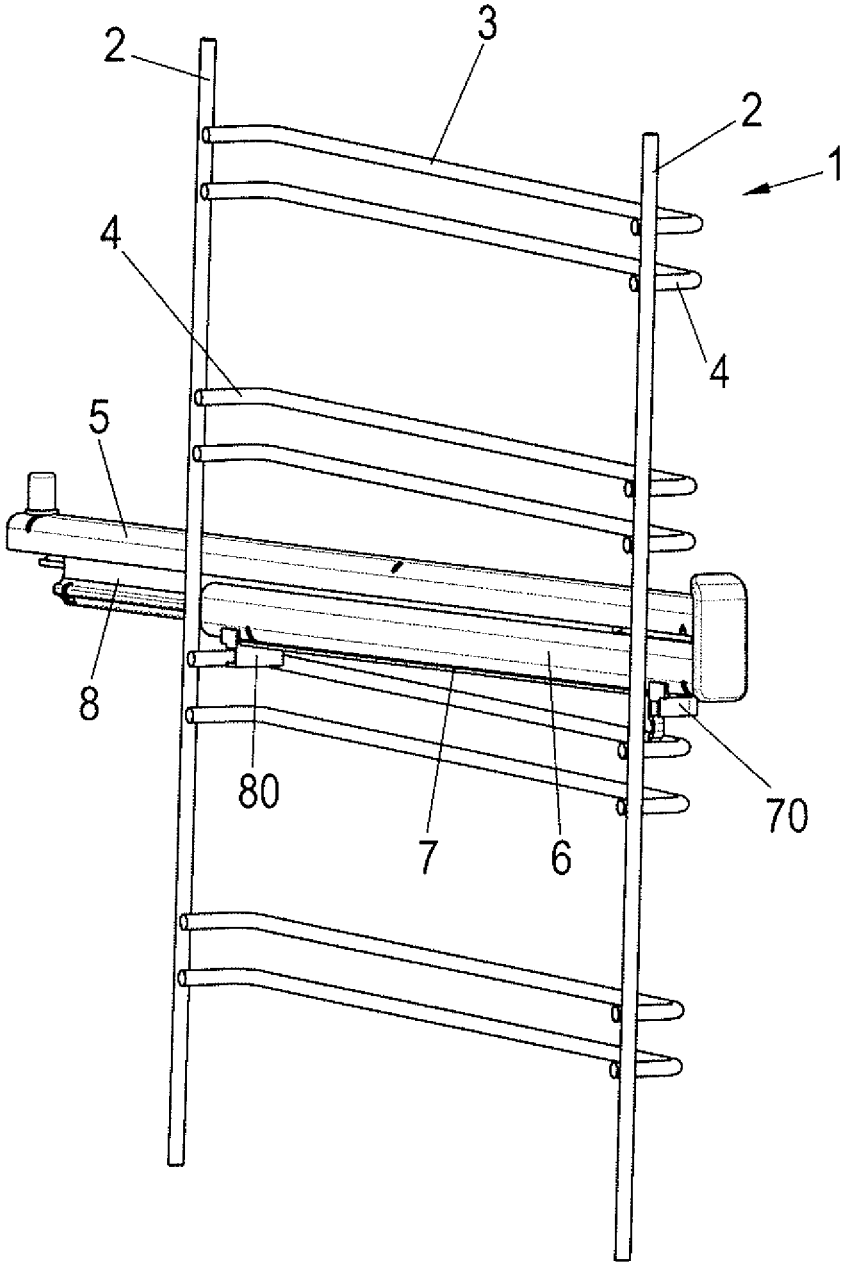
FIGS. 10A to 10C show several views of fourth embodiment of a quick fastening device during assembly, in accordance with the present disclosure.
Figure 10B:
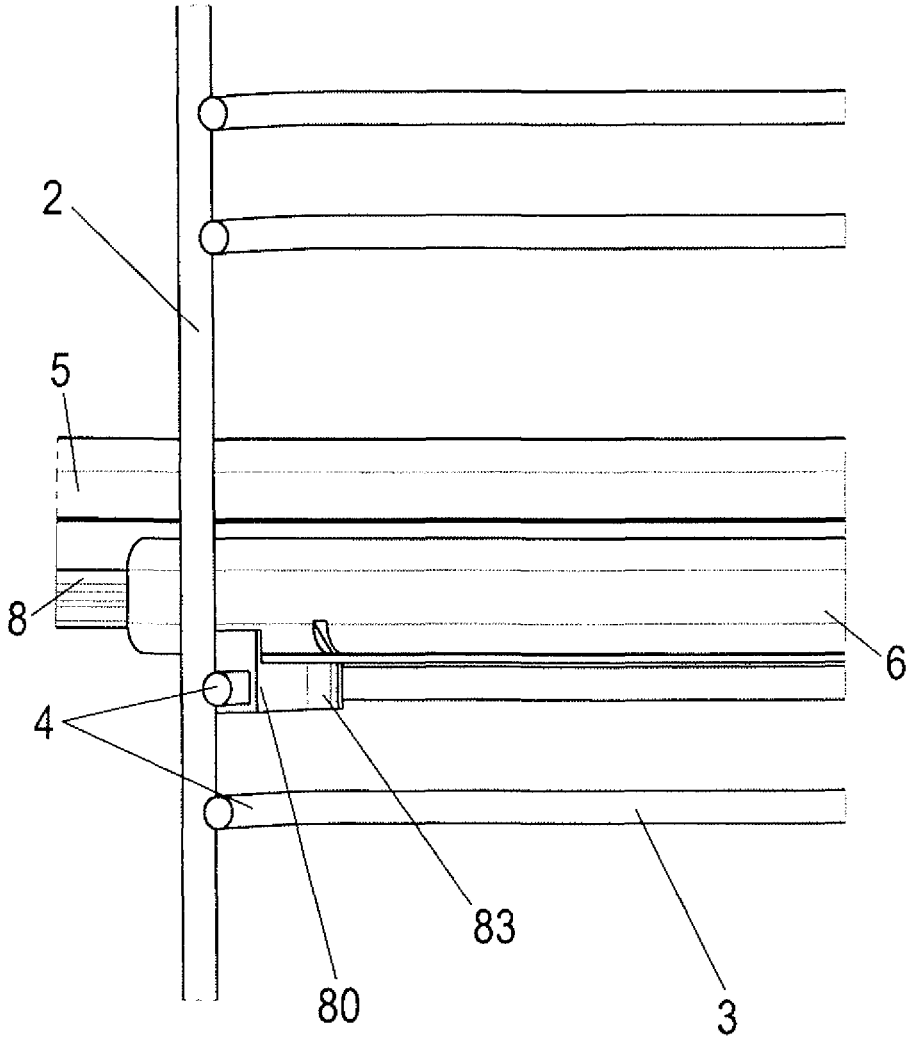
Figure 10C:
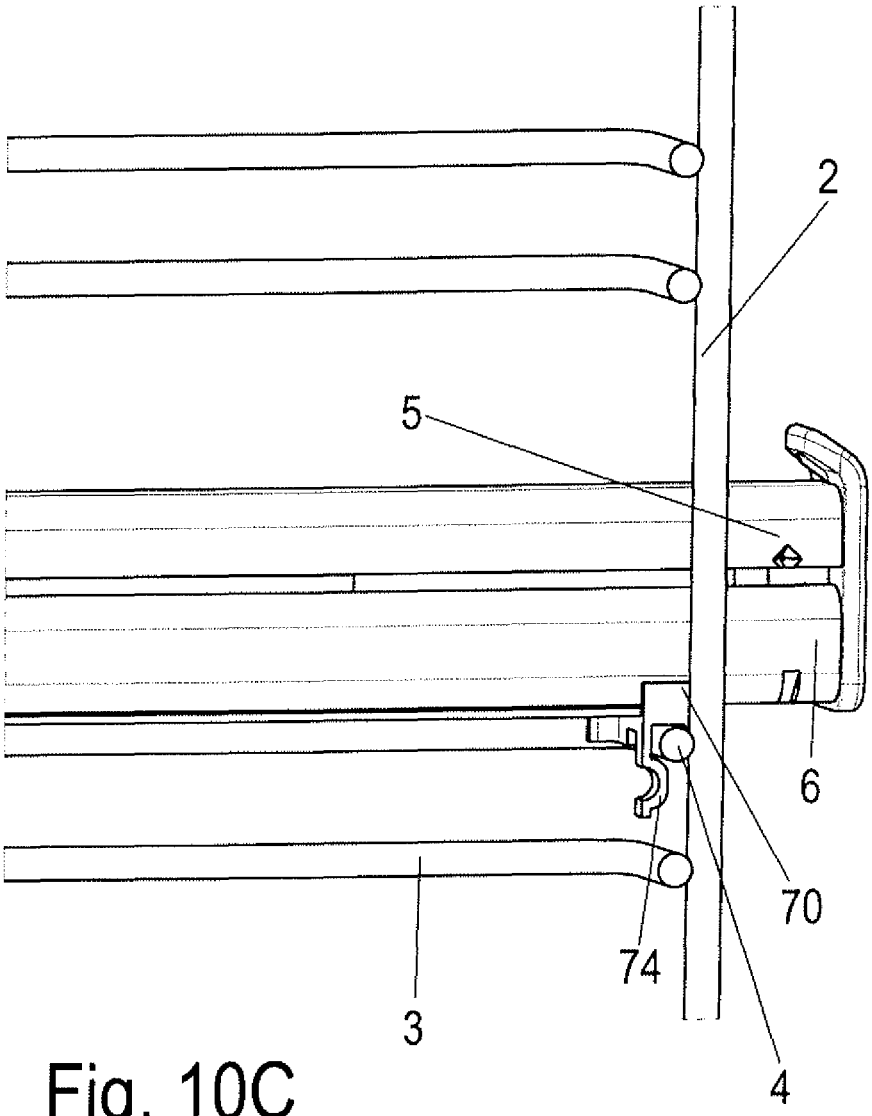

FIGS. 10A to 10C show another embodiment of a quick fastening device, in accordance with the present disclosure, for fastening a guide rail 6 of a pull-out guide on a side grid 1. This quick fastening device includes a front clamp 70 and a rear clamp 80 which are fixed on the guide rail 6 or a strip 7 connected to the guide rail 6.

Figure 11:
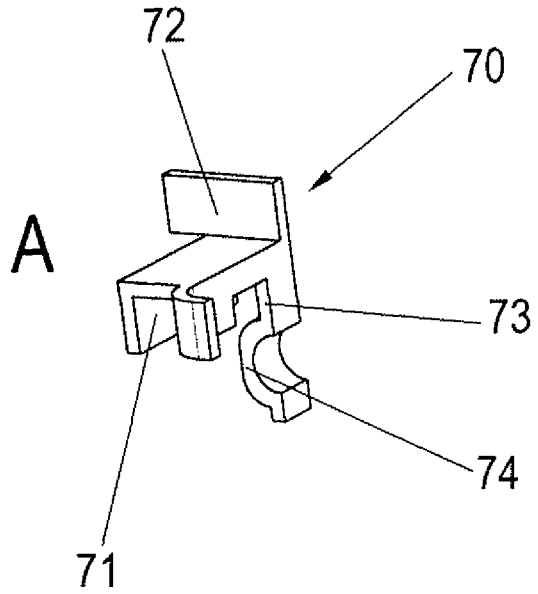
FIGS. 11A and 11B show two views of the clamps of the quick fastening device of FIGS. 10A to 10C.
Figure 11:
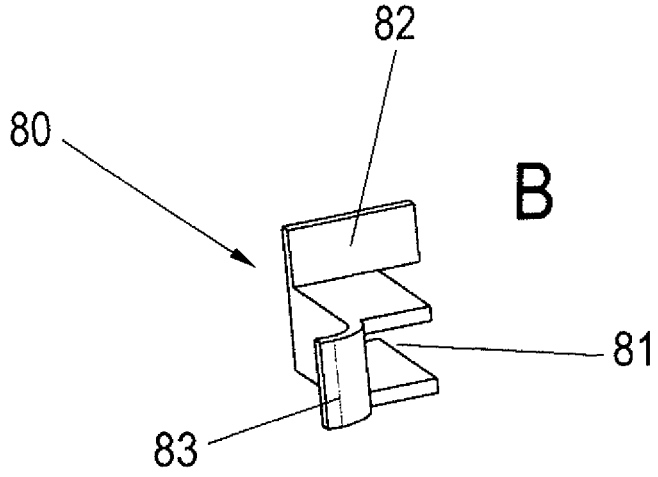

As can be seen from FIGS. 11A and 11B, the front clamp 70 includes a U-shaped receptacle 71 open at the bottom for encompassing bent end section 4 of a horizontal web 3. A vertical plate 72 is formed above the receptacle 71, which serves as a stop and, for example, can be placed on the vertical post 2. A downwardly directed resilient web 73, on which a latching projection 74 projects, is formed integrally with the U-shaped receptacle 71.

The rear clamp 80 includes a horizontally aligned U-shaped receptacle 81 which serves to encompass bent end section 4 of a rod 3. A plate-shaped stop 82 is formed adjacent to the U-shaped receptacle 81, which, for example, can be placed on a vertical post 2. A curved web 83 is provided on the side opposite the stop 82, which web can, for example, be placed with its inside on the horizontal rod 3 in the area of the transition between the region of the longitudinal extension and the bent end section 4.

The clamps 70 and 80 are mounted by first pushing the rear clamp 80 onto the end section 4 so that the clamp 80 is disposed between the post 2 and the region of the longitudinal extension of the rod 3. The guide rail 6 is then pivoted downwards so that the U-shaped receptacle 71 is pushed from above onto the bent end section 4 and is engaged via the latching projection 74.

The present disclosure is not restricted to the exemplary embodiments shown and described herein. It is within the scope of the present disclosure to position the latching means and U-shaped receptacles at different points of the individual clamps and also combine the individual embodiments disclosed herein with one another.

The quick fastening device can, within the scope of the present disclosure, be assembled in the horizontal direction from inside or from the front but it is also, within the scope of the present disclosure, to pivot the clamps onto the side grid 1 on a rod 3, a post 2 or bent end section 4.

Although the present disclosure has been described and illustrated in detail, it is to be clearly understood that this is done by way of illustration and example only and is not to be taken by way of limitation. The scope of the present disclosure is to be limited only by the terms of the appended claims.

I claim:

1. A quick fastening device for fastening a pull out guide to a baking oven, household appliance, or piece of furniture, the pull out guide having a guide rail, a running rail, and a middle rail between the guide rail and the running rail, the guide rail being fastened to a vertically extending post and to a horizontally extending rod of a grid of the baking oven, household appliance, or piece of furniture, the horizontally extending rod having a bent end section on each end of the rod, one of the bent end sections being fixed to the post, the quick fastening device comprising:

a first clamp fixed to one end of the guide rail, the first clamp encompassing one of the bent end sections of the horizontally extending rod;

a second clamp fixed to one end of the guide rail and the second clamp encompassing a section of the vertically extending post;

a stop formed on each of the clamps, the stops configured to abut against the post on a side of the post facing the guide rail;

wherein the first clamp is fixed on the bent end section of the rod by a latching mechanism; and wherein each of the clamps provides support under a loading of the pull-out guide to prevent a pivoting movement of the pull-out guide.

2. The quick fastening device according to claim 1, wherein at least one of the stops is formed in the shape of a plate.

3. The quick fastening device according to claim 1, wherein at least one of the stops is formed as a holder having the shape of a U.

4. The quick fastening device according to claim 1, wherein the latching mechanism is formed as bendable webs on the clamps.

5. The quick fastening device according to claim 1, wherein at least one of the clamps includes two U-shaped receptacles disposed at an angle to one another.

6. The quick fastening device according to claim 1, wherein the clamps are fixed on a strip which is connected to the guide rail.

7. The quick fastening device according to claim 1, wherein the clamps are formed integrally with the guide rail.

8. The quick fastening device according to claim 1, wherein the guide rail is disposed at least partially above the horizontally extending rod.

9. The quick fastening device according to claim 1, wherein the latching mechanism encompasses at least one of the horizontally extending rod and the vertically extending post over more than half a diameter of the horizontally extending rod or the vertically extending post.

10. The quick fastening device according to claim 1, wherein the latching mechanism includes a run-in slope formed on a side facing away from one of the horizontally extending rod and the vertically extending post.

11. The quick fastening device according to claim 1, wherein at least one of the clamps includes two U-shaped receptacles which encompass the bent end section from one side of the bent end section in a manner of a claw and are engaged at another side of the bent end section by a lowering of at least one of the clamps onto the bent end section.

12. The quick fastening device according to claim 1, the grid configured for fixing to an outer wall of an inner compartment of the baking oven, household appliance, or piece of furniture, the bent end sections of the horizontally extending rod facing the outer wall and away from the inner compartment.

13. A quick fastening device for fastening a pull out guide to a baking oven, household appliance, or piece of furniture, the pull out guide having a guide rail, a running rail, and a middle rail between the guide rail and the running rail, the guide rail being fastened to a vertically extending post and to a horizontally extending rod of a grid of the baking oven, household appliance, or piece of furniture, the horizontally extending rod having a bent end section on each end of the rod, one of the bent end sections being fixed to the post, the quick fastening device comprising:

a first clamp fixed to one end of the guide rail, the first clamp encompassing one of the bent end sections of the horizontally extending rod;

a second clamp fixed to one end of the guide rail and the second clamp encompassing a section of the vertically extending post;

a stop formed on each of the clamps, the stops configured to abut against the post on a side of the post facing the guide rail;

wherein at least one of the clamps includes two U-shaped receptacles which encompass the bent end section from one side of the bent end section in a manner of a claw and are engaged at another side of the bent end section by a lowering of at least one of the clamps onto the bent end section; and wherein each of the clamps provides support under a loading of the pull-out guide to prevent a pivoting movement of the pull-out guide.

* * * * *